US008973706B2

(12) United States Patent
Bambrick et al.

(10) Patent No.: US 8,973,706 B2
(45) Date of Patent: Mar. 10, 2015

(54) LIFE SAVING DEVICE FOR THE HOME

(71) Applicants: David Patrick Bambrick, Cambridge, MD (US); Mary Katherine Bambrick, Cambridge, MD (US)

(72) Inventors: David Patrick Bambrick, Cambridge, MD (US); Mary Katherine Bambrick, Cambridge, MD (US)

( * ) Notice: Subject to any disclaimer, the term of this patent is extended or adjusted under 35 U.S.C. 154(b) by 0 days.

(21) Appl. No.: 14/120,016

(22) Filed: Apr. 15, 2014

(65) Prior Publication Data

US 2014/0345969 A1 Nov. 27, 2014

Related U.S. Application Data

(62) Division of application No. 13/815,151, filed on Feb. 4, 2013, now Pat. No. 8,708,101.

(51) Int. Cl.
*A62B 1/20* (2006.01)

(52) U.S. Cl.
CPC ..... *A62B 1/20* (2013.01)
USPC ..... 182/48; 182/70; 182/18

(58) Field of Classification Search
USPC ..... 182/48, 70, 18
See application file for complete search history.

(56) References Cited

U.S. PATENT DOCUMENTS

| | | | | |
|---|---|---|---|---|
| 293,137 | A | | 2/1884 | Bennett |
| 3,910,532 | A | | 10/1975 | Fischer |
| 4,162,717 | A | | 7/1979 | Orii et al. |
| 4,375,877 | A | * | 3/1983 | Shorey ..... 244/137.2 |
| 4,544,517 | A | | 10/1985 | Ohno |
| 4,582,166 | A | | 4/1986 | Baker |
| 5,060,753 | A | | 10/1991 | Hopkins |
| D340,965 | S | | 11/1993 | Lee |
| 5,842,539 | A | | 12/1998 | Hough |
| 6,082,491 | A | | 7/2000 | Collier |
| 6,298,970 | B1 | | 10/2001 | Targiroff et al. |
| 6,536,715 | B1 | | 3/2003 | Moran et al. |
| 6,641,445 | B1 | | 11/2003 | Jurlina et al. |
| 6,644,596 | B1 | | 11/2003 | Jurlina et al. |
| 6,676,082 | B2 | | 1/2004 | Alberts |
| 6,684,978 | B1 | | 2/2004 | Gupta |
| 6,814,183 | B2 | | 11/2004 | Horvath et al. |
| 6,966,414 | B2 | | 11/2005 | Zonneveld |
| 7,090,168 | B1 | | 8/2006 | Brown |
| 7,159,823 | B1 | | 1/2007 | Paustian et al. |
| 7,434,600 | B1 | | 10/2008 | Swierkocki et al. |
| 7,467,496 | B1 | | 12/2008 | Cuisset et al. |
| 7,467,764 | B2 | | 12/2008 | Hintzman |
| 7,644,739 | B1 | | 1/2010 | Vezzosi et al. |
| 7,681,515 | B1 | | 3/2010 | Apple |
| 8,162,105 | B1 | | 4/2012 | Ohland |
| 8,215,586 | B2 | | 7/2012 | O'Donnell et al. |
| 2005/0115794 | A1 | | 6/2005 | Zonneveld |
| 2007/0284188 | A1 | | 12/2007 | Chippindale |
| 2008/0223656 | A1 | | 9/2008 | John |

* cited by examiner

*Primary Examiner* — Alvin Chin-Shue
(74) *Attorney, Agent, or Firm* — Leander F. Aulisio

(57) ABSTRACT

The present invention relates to a life-saving apparatus and method for escaping from a second floor or a third floor of a burning building, wherein the life-saving apparatus includes a container, a set of wheels, an inflatable pillow, an inflatable slide, a set of canisters full of compressed gas, and a set of activators operatively connected to the canisters.

2 Claims, 7 Drawing Sheets

LIFE SAVING DEVICE FOR THE HOME

The present application is a divisional application of non-provisional patent application Ser. No. 13/815,151, now U.S. Pat. No. 8,708,101, which is based on provisional U.S. patent application Ser. No. 61/633,771, filed on Feb. 17, 2012.

BACKGROUND OF THE INVENTION

Evacuation slides are used by the airlines in the event of an emergency. Airlines require the evacuation slide to deploy in 6 seconds in temperatures ranging from −65 to 160 degrees F., and to unfurl in winds of up to 28 miles per hour. The Goodrich Company in Phoenix, Ariz. is a supplier for airplane evacuation systems. Material useful in airplane evacuation systems is characterized as follows: "a urethane-coated nylon that is sprayed with gray aluminized paint which protects the slide from fire that is nearby by reflecting heat for at least 90 seconds of the slide's deployment." The Goodrich Company also supplies the means for inflating the airplane evacuation system wherein the means includes an initial boost from a canister of compressed gas such as carbon dioxide, nitrogen or the like.

Evacuation slides are also employed as devices for escaping a burning building from an upper floor of the building.

US Patent Application Publication No. 2008/0223656 discloses a self-deploying automatic inflatable fire escape (SAFE) unit wherein the unit represents a reliable means for rapid escape from a burning building when usual exits are dangerous. The Self-deploying Automatic inflatable Fire Escape (SAFE) is a building component containing a compressed and folded slide that is installed into an edifice during construction as an integral part of a window casement or wall, or is retrofitted under a pre-existing window, and is automatically deployed by equipment which detects a dangerous condition, sounds an alarm, notifies emergency organizations by a dial-up, opens an aperture in the wall and extends the slide by opening a valve and releasing compressed gas into an inflatable volume which is distended to become a walled chute to the ground.

US Patent Application Publication No. 2007/0284188 discloses an evacuation slide having lateral ridges. The slide is designed to be mounted proximate a window of a multi-story building. The evacuation slide includes a storage chamber that has substantially disposed therein an inflator and the evacuation slide in its un-deployed condition. The evacuation slide further consists of two main support tubes generally parallel and extending downward with each other when the slide is in its deployed condition. Interposed the main support tubes is a flexible sliding surface. Substantially disposed on the sliding surface is a plurality of speed control ridges that extend upward to control the descent rate of an individual traversing down the evacuation slide.

US Patent Application Publication No. 2005/0115794 discloses an elevated inflatable emergency evacuation slide. The slide includes a flexible slide surface that is supported by longitudinal main support members. Illumination of the slide surface is provided by a plurality of illumination sources that are supported above the upper surface of the main support members on inflatable stanchions that extend upward from the upper surface of the main support members. The plurality of illumination sources may be high efficiency light emitting diodes or other high efficiency light sources. By providing an illumination source that is elevated above the upper surface of the main support members, a greater portion of the slide surface can be illuminated without shadows.

U.S. Pat. No. 6,298,970 discloses an inflatable evacuation slide with an adjustable decelerator. The inflatable evacuation slide is useful in aircraft, watercraft, buildings, and other structures. The slide includes a first inflatable tubular member, a second inflatable tubular member spaced from the first inflatable tubular member, and a floor extending between the first and second inflatable tubular members. At least one adjustable deceleration tube is connected to the floor. The at least one deceleration tube is adjustable in height in response to the distance between the exit opening and ground. With this arrangement, the rate of descent of an evacuee descending the evacuation slide can be regulated based on the height of the exit opening.

U.S. Pat. No. 6,082,491 discloses an inflatable slide for attachment to a house window wherein the slide includes an elongated self-inflating slide portion having an upper end, an enlarged lower end, and an intermediate extent there-between. The slide portion further includes a pair of opposed raised side portions extending a length thereof with a generally planar central sliding portion disposed there-between. The upper end is secured to an outside of a house immediately below a window of the house whereby an unobstructed space exists between the window and a ground surface there-below. The slide portion has a length greater than a length between the window and the ground surface whereby the enlarged lower end rests on the ground surface creating an obtuse angle with respect to the slide portion. A safety system is coupled with respect to the slide portion. The safety system prevents a user from falling off the slide portion during use.

None of the above-referenced patents and patent applications, taken either individually or in combination, serve to anticipate the invention as presently disclosed and claimed.

SUMMARY OF THE INVENTION

The present invention relates to a device useful for saving human lives in case of a house fire. In an embodiment, the slide of the present invention is smaller in length and in width than that of the airplane evacuation slide. The device includes an elongated inflatable slide, an inflatable pillow smaller than the inflatable slide wherein the pillow is located at the base of a container and wherein the pillow is operatively connected to the slide, a first canister operatively connected to the inflatable pillow, a second canister operatively connected to the inflatable slide, wherein both the first and second canisters contain compressed gas, a first activator and a second activator wherein the first activator is operably connected to the first canister and the second activator is operably connected to the second canister, and a generally rectangular container wherein the slide, the pillow, and the first and second canisters are located within the container. A gripping fabric operatively connects the pillow to the slide. The gripping fabric covers the window sill once the device is activated. In an embodiment, the gripping fabric can be a coarse material such as a mat of glass fibers embedded in a polymeric matrix. The coarse material can be woven or nonwoven.

A generally rectangular container can be employed. The container has a bottom, four sides and a removable top. In an embodiment, the top can be connected to a side of the container with one or more hinge means. In a further embodiment the top can have a latch, wherein the latch, in a closed position, keeps the top from being opened.

DETAILED DESCRIPTION OF THE INVENTION

Figure 1:
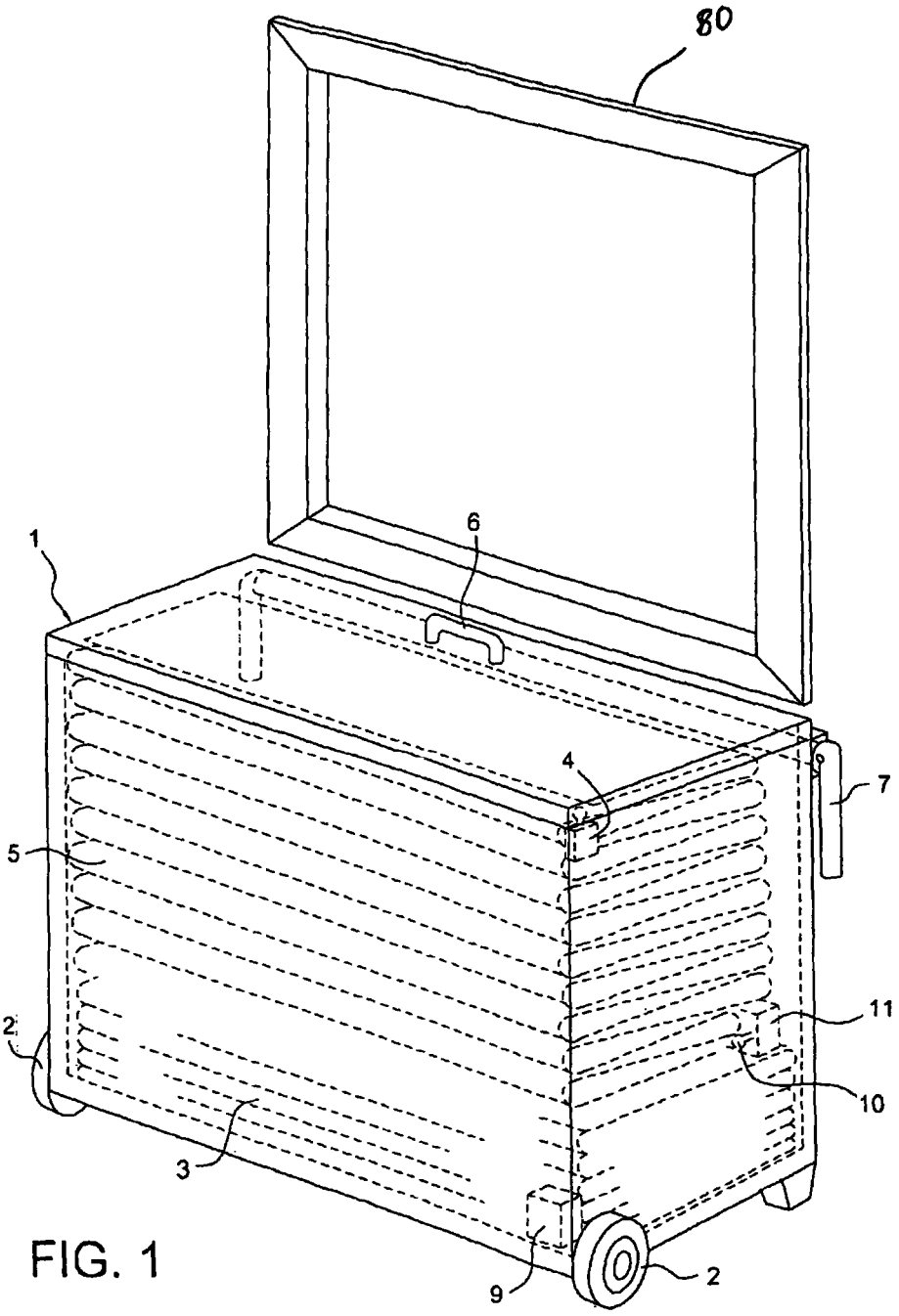
FIG. 1 is a representation of an embodiment of the present invention wherein the container which holds the inflatable pillow and the inflatable slide is positioned underneath a window on a second floor or third floor of a home.

A life-saving device for the home is herein disclosed. The life-saving device includes a generally rectangular container. Within the container is an inflatable pillow. When in a fully inflated condition, the pillow fills substantially the entire volume of the container. A first canister includes a compressed gas, such as carbon dioxide, nitrogen or mixtures thereof. The first canister is positioned at the bottom of the container. In an embodiment, the first canister is positioned inside the container. A first activator is operatively connected to the first canister. The first activator is positioned at the top of the container. An inflatable elongated slide is operatively connected to the inflatable pillow. The slide is positioned on top of the inflatable pillow and within the container. In a fully inflated condition, the slide reaches the ground from an upper window of a building. A second canister includes a compressed gas, such as carbon dioxide, nitrogen or mixtures thereof. The second canister can be located inside or outside the container. A second activator is operatively connected to the second canister. The second activator can be located at a proximal end of the inflatable slide. The proximal end of the inflatable slide is the end closest to the inflatable pillow. The second activator is not visible until the inflatable slide is pushed out an open window.

The container of the life-saving device includes a bottom, four sides and a top. The top is operatively connected to a side of the container. At least one hinge can be employed to connect the top to a side of the container. In an embodiment, the hinges are located on a side of the container opposite a metal bar, wherein the metal bar is useful for securing the container underneath an internal window ledge, thus securing the deployed slide in position. At least one latch is operatively connected to the top of the container and to a side of the container. The latch can be employed to lock the top of the container, and to unlock the top of the container.

The life-saving device is movable. The container includes at least two wheels located at the bottom of the container. If two wheels are employed, then two studs are located opposite the set of wheels to stabilize the container. In an alternative embodiment, the container includes four wheels. The wheels are located at the bottom of the container for ease of movement.

The life-saving device includes a locating device. The locating device can be a strobe light, a siren, a buzzer, a photoluminescent material that illuminates in low ambient light conditions or the like. The locating device can be automatically activated by heat or by smoke.

The life-saving device includes a metal bar having a rotatable metal section at each end. The metal bar is located generally near the top of the container and is operatively connected thereto. The two rotatable metal sections attached to the metal bar can be rotated upwardly and outwardly to contact the base of a window sill.

In an embodiment, the elongated inflatable slide has a length of about 15 feet to about 40 feet. In an alternative embodiment the slide has a length of about 20 feet to about 30 feet. Upon inflation, the slide has a width of about 30 inches to about 60 inches. In an embodiment, the slide, upon inflation, has a width of about 36 inches. Further, upon inflation, the slide has raised sides, wherein the sides have a height of about 4 inches to about 20 inches. In an alternative embodiment the raised sides have a height of about 6 inches to about 10 inches.

The elongated inflatable slide is made of a suitable high strength, flame resistant material. In an embodiment the material can include a nylon fabric coated with a flame resistant polyurethane film. In an embodiment, the polyurethane film is coated with an aluminized paint. By "aluminized paint" is meant a paint composition that contains aluminum flakes or the like. In an embodiment, the aluminized paint can be sprayed onto the polyurethane film. Preferably, the aluminized paint is gray in color. The aluminized paint reflects heat away from the slide for a time of about ninety seconds to about one hundred and eighty seconds after the slide has been activated. This allows for the slide to be operable even when fire is close to the slide.

The life saving device includes an elongated inflatable slide; an elongated inflatable pillow, wherein the pillow is operatively connected to the slide; a first canister wherein the first canister is operatively connected to the inflatable pillow; a second canister operatively connected to the inflatable slide, wherein both the first and second canisters contain compressed gas; a first activator and a second activator, wherein the first activator is operably connected to the first canister and the second activator is operably connected to the second canister; and a container wherein the slide, the pillow, and the first canister are located within the container. The second canister may also be located in the container or under the deployed slide. In an embodiment, the container is generally rectangular in shape. The device further contains a gripping fabric, wherein the fabric operatively connects the pillow to the slide. The gripping fabric covers the window sill of the opened window when the device is activated. In an embodiment, the container has a rectangular shape. In an alternative embodiment, the top of the pillow is operatively connected in a direct manner to the proximal end of the elongated slide. By "direct manner" is meant that the top of the pillow is connected to the slide by means of sewing, stapling, riveting, heat sealing or the like; without the need for the gripping fabric. The proximal end of the inflatable elongated slide is the end that is closest to the pillow. The distal end of the slide is the end that is closest to the ground when the slide is fully inflated.

In an embodiment, the bottom of the inflatable pillow can be permanently attached to the inside bottom of the container as by an adhesive material, a rivet or bolt, a hook and loop attachment, or the like. In an embodiment, the container has a height of about three feet to about four feet. In an embodiment, the container has at least two wheels attached to the bottom. Studs can be positioned on the corners at the opposite ends of the wheels to balance the container in standing position. In an alternative embodiment, the container can be outfitted with four wheels, wherein one wheel is positioned at each corner at the bottom of the container.

The container includes a bottom, four sides and a removable top. The removable top can be connected to a side of the container with one or more hinge means. The top can have a latch, wherein the latch, in a closed position, keeps the top from being opened. On the bottom and at the middle of the box is a strobe light, siren, photoluminescent material or the like, that allows a person to locate the box and slide if the room is full of smoke or there is low ambient light. The strobe light or siren, or the like, can be automatically activated by heat and/or smoke.

The present invention relates to a method of escaping a burning building from a second floor of the burning building, or in some cases an even higher floor. The method includes: rolling a life saving device to a position directly underneath a window on the second floor or the third floor; and opening the window wherein the window is opened to a position wide enough to allow a person egress from the window.

The method further includes: securing the container underneath the opened window so that the container will not be pulled out of the window upon inflation of the slide. The container includes a metal bar having at each end of the bar a movable metal section that is hingedly connected to the metal bar. The metal bar is operatively connected to the top of the container. The two metal sections of the metal bar can be pulled upward and outward to obtain an extended position. The two bars can be locked in this extended position by a locking mechanism. In their extended position, the two bars are snugly positioned directly underneath the windowsill. The two bars, now in a snug relationship with the underside of the window sill, substantially lock the container securely underneath the opened window.

A handle is operatively connected to the container. The handle is designed to operate like the roll-away travel bags commonly employed in airports. The handle is useful for moving the life saving device from one room to another.

In an alternative embodiment, two handles are employed. The two handles are operatively connected to the container at the sides of the container. These two handles can be lifted upward and positioned below the window sill of the opened window. When the handles are positioned below the window sill and the metal bars are positioned below the window sill, the container is securely locked in position below the inside window sill of the opened window. The container will not be pulled outside the window when the slide is inflated.

The method includes: securing the container directly underneath the opened window by extending the two metal sections of a metal bar to their locked positions underneath the window sill; pulling two handles up from the sides of the container and securing the handles below the window sill; opening the top of the container in a direction away from the window; and pulling the first activator, wherein the first activator is located inside and near the top of the opened container. The first activator is plainly visible once the top of the container is opened. Pulling the first activator causes the first canister to release a stream of compressed gas into the inflatable pillow. In an embodiment, the pillow can be in a partially inflated condition when positioned in the container. In a further embodiment, the inflatable pillow includes at least one valve or aspirator that allows air from the atmosphere to be pulled into the pillow in combination with compressed gas from the first canister. The pillow fills substantially the entire space within the container when inflated. This allows easy access to the inflatable slide, wherein the inflatable slide can now be pushed outside an open window.

The inflatable slide is stored in a generally folded condition, such as in an accordion-like position, within the container. The inflated pillow forces the inflatable slide outside the container. When the inflatable slide is in the generally folded condition, but not at an angle to the container and the inflated pillow, a second activator is not visible. Once the inflatable slide is pushed outside the window, the second activator becomes visible. Pulling the second activator causes the second canister to release a stream of compressed gas into the inflatable slide.

In an embodiment, the life saving device includes an inflatable bumper at the distal end of the elongated slide. The inflatable bumper can be inflated by the same activator device that activates the second canister. The inflatable bumper can be inflated immediately after the slide is inflated. The inflatable bumper serves to stop a person after he or she has reached the end of the slide. Preferably, the end of the slide is about five feet to about ten feet from the point on the ground where the slide begins to touch the ground.

The method further includes: pushing the inflatable slide outside the window; adjusting the gripping fabric over the window sill; pulling the second activator, wherein the second activator is positioned near the top of the inflatable slide and is now visible; securing the gripping fabric to the window sill; and sliding down the inflated slide. The gripping fabric, once secured over the window sill, provides a stable launching pad for an individual to position oneself before he/she begins to slide. In an embodiment, a person can go down the slide in a feet-first position. In an alternative embodiment, the person can go down the slide in a head-first position.

The second activator is operatively connected to the second canister. The second canister is located near the top of the container at the inside. The second activator is located preferably underneath the inflatable slide at the proximal end of the slide. The second activator is not visible until the pillow is fully inflated and the un-inflated slide is at a generally 45 degree angle to the container and the inflated pillow. If a child accidentally inflates the pillow by pulling the first activator, the child will not even see the second activator, since it is not visible when the un-inflated slide is simply sitting atop the inflated pillow. The un-inflated slide must be at an angle, such as outside the window, in order for the second activator to be visible. This feature is important to safeguard the integrity of the life saving device.

In an embodiment, the slide can include a plurality of valves (aspirators) to pull ambient air into the inflatable slide along with the compressed gas in the canister. The step of pulling the second activator has the effect of inflating the slide in a time of less than about 15 seconds. In an embodiment, the slide is fully inflated in a time of about 6 seconds to about 10 seconds.

In an embodiment, the inflatable pillow and inflatable slide are packaged in a container having the following dimensions: a height of about 30 inches to about 40 inches, a width of about 30 inches to about 40 inches, and a depth of about 20 inches to about 40 inches. Preferably, the container has a height of about 31 inches, a width of about 36 inches and a depth of about 24 inches. A standard bedroom window on the second floor or third floor is about 36 inches from the floor. In an embodiment, the container resembles a piece of furniture suited for the bedroom or hallway. A device for use on the third floor of a home includes a slide that is longer than the slide for use on the second floor. The second floor slide is typically about 20 feet to about 30 feet in length.

The life-saving device of the present invention can be stored on the second floor or third floor of a home. Alternatively, the life saving device can be added as part of construction of a new home. Ideally, a device of the present invention can be installed in each second floor or third floor bedroom of the home. The life-saving device is mobile. This allows for easy transport between rooms of a home, especially if the location where the life-saving device is stored is compromised by fire, heat, smoke or the like. In an embodiment, the life-saving device can be fitted with a fabric cover so that the device can be integrated into the home décor while being stored near a window of the home. The fabric cover can have various patterns and designs for better integration into the décor of the home.

A canister containing a compressed gas, useful for inflating the pillow and the slide, is available from The Goodrich company of Phoenix, Ariz. And numerous other outlets. The canister is lightweight and small in size, being not much larger than a can of soda. When the canister is activated, it produces a highly compressed gas within seconds.

Referring to FIG. 1, a schematic diagram of the Life Saving Device for the Home is represented. The life saving device is positioned underneath a window 80. The container 1 holding the inflatable slide has two wheels 2 near the bottom of the container 1. At the top of the container 1 is a handle 6, which is used to transport the container 1. At the bottom of the inside of the container 1 is the inflatable pillow 3. On top of the pillow 3 is the inflatable slide 5, wherein the inflatable slide 5 is in a tightly folded position. In an embodiment, the inflatable slide 5 is a urethane coated nylon slide. The inflatable slide 5 can also be made of other suitable materials which are preferably fire retardant or fire proof. The slide 5 is 24 feet long and 36 inches wide with 6 inch high sides when fully inflated.

Fitted to the back side and near the top of the container 1 is a metal bar 7, wherein the metal bar 7 is built into the container 1 to be positioned along the wall and window frame base. In an embodiment, the length of the metal bar is about 40 inches to about 50 inches. Preferably, the metal bar has a length of about 42 inches. Two handle latches 7 are facing down when not in use. When activated, the handles 7 are pulled up parallel with the window ledge. They prevent the container 1 from being pulled out the window when the life saving device is activated. There are two activators which are pulled in order for the pillow and slide to inflate. The first activator 4 is located at the top side and within the container 1. The first activator 4 is operably connected to the first canister 9 which contains a compressed gas. In the event of emergency, the operator opens the top in a direction away from the opened window. The operator then pulls the first activator 4, wherein compressed gas from the first canister 9 inflates the pillow 3. The pillow 3 pushes the slide 5 up and out of the container 1. The operator must then push the inflatable slide 5 out of the open window to expose the previously hidden second activator 10, wherein the second activator 10 is operably connected to the second canister 11. The second canister 11 contains an amount of compressed gas. The operator can then pull the second activator 10 to inflate the slide 5.

Figure 2:
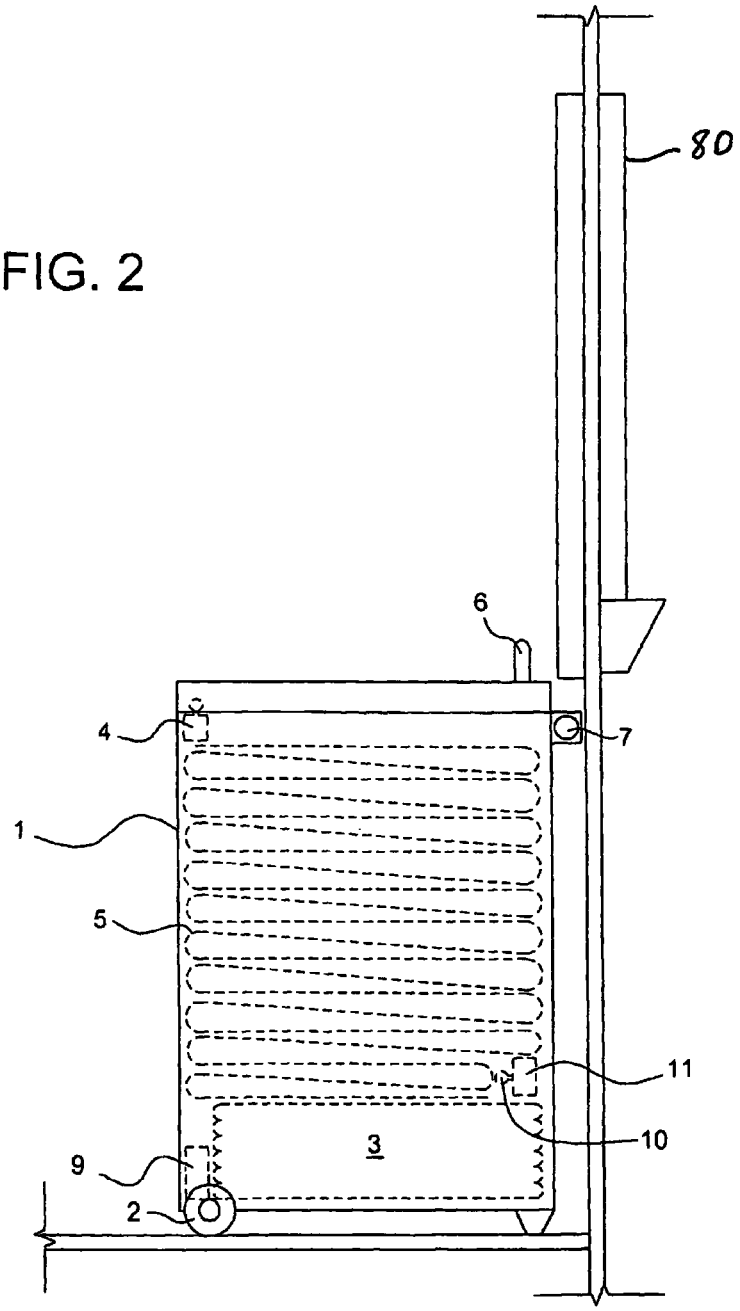
FIG. 2 is a representation of an embodiment of the present invention wherein the side of the container is cut away to show the contents of the container from a side view.

Referring to FIG. 2, a schematic diagram of the Life Saving Device for the Home is presented to represent a cut-away of the side of the container 1. The life saving device is positioned underneath a window 80. The container 1 holding the inflatable slide has two wheels 2 near the bottom of the container 1. At the top of the container 1 is a handle 6, which is used to transport the container 1. At the bottom of the inside of the container 1 is the inflatable urethane coated nylon pillow 3. On top of the pillow 3 is the inflatable slide 5, wherein the inflatable slide 5 is in a tightly folded position. It is 24 feet long and 36 inches wide with 6 inch high sides when fully inflated. Fitted to the back side and near the top of the container 1 is a metal bar 7, wherein the metal bar 7 is built into the top of the container 1 to be positioned along the wall and window frame base. In an embodiment, the length of the metal bar is about 40 inches to about 50 inches. Preferably, the metal bar has a length of about 42 inches. Two handle latches 7 are facing down when not in use. When activated, the handles 7 are pulled up parallel with the window ledge. They prevent the container 1 from being pulled out the window when the life saving device is activated. There are two activators which are pulled in order for the pillow and slide to inflate. The first activator 4 is located at the top side and within the container 1. The first activator 4 is operably connected to the first canister 9 which contains a compressed gas. In the event of emergency, the operator opens the top in a direction away from the opened window. The operator then pulls the first activator 4, wherein compressed gas from the first canister 9 inflates the pillow 3. The pillow 3 pushes the slide 5 up and out of the container 1. The operator must then push the inflatable slide 5 out of the open window 80 to expose the previously hidden second activator 10, wherein the second activator 10 is operably connected to the second canister 11. The second canister 11 contains an amount of compressed gas. The operator can then pull the second activator 10 to inflate the slide 5.

Figure 3:
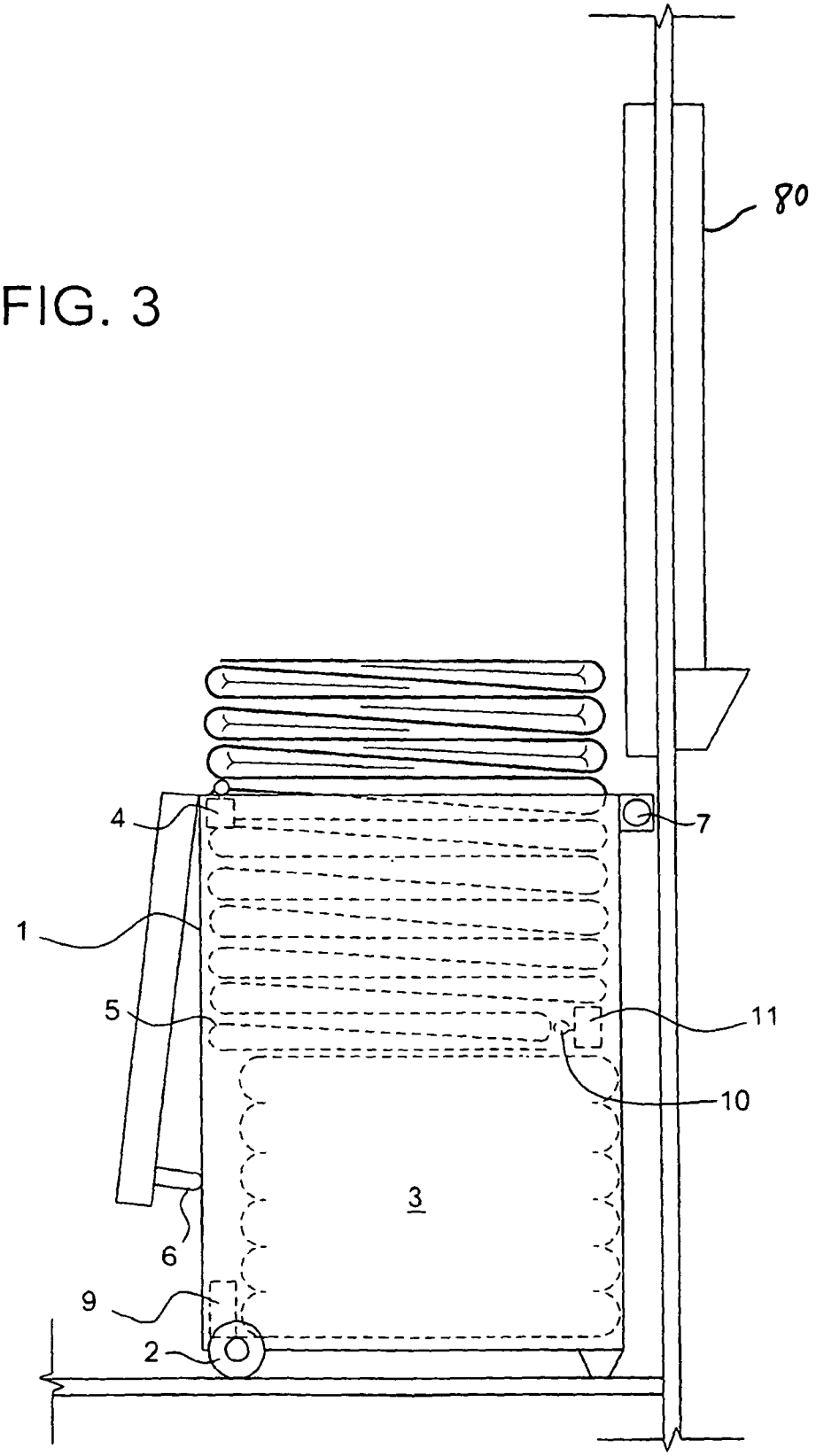
FIG. 3 is a representation of an embodiment of the present invention wherein the first canister has been activated, and the inflated pillow has pushed the slide out of the container.

Referring to FIG. 3, a schematic diagram of the Life Saving Device for the Home is presented wherein the pillow 3 is inflated and the slide 5 is out of the container 1. The slide 5 is not yet inflated and is positioned in front of the window. The operator would then push the slide forward, out of the window. When the slide 5 is pushed forward, the second activator 10 becomes visible. The operator pulls the handle 10, which opens the canister 11. In an embodiment, the canister 11 includes a compressed gas such as carbon dioxide, nitrogen or the like. The canister 11 provides generally one-third of the volume needed to inflate the slide. The remaining volume is supplied by ambient air (a colorless, odorless, tasteless, gaseous mixture composed of approximately 78% nitrogen and 21% oxygen, with lesser amounts of argon, carbon dioxide, hydrogen, neon, helium, and other gas). The ambient air is channeled into the sides of the slide through aspirators or funnels (not shown) to fill the slide. When the slide is fully inflated, the aspirators are automatically forced to close. In an alternative embodiment, the canister can fill the entire slide without the use of aspirators or other such devices.

Figure 4:
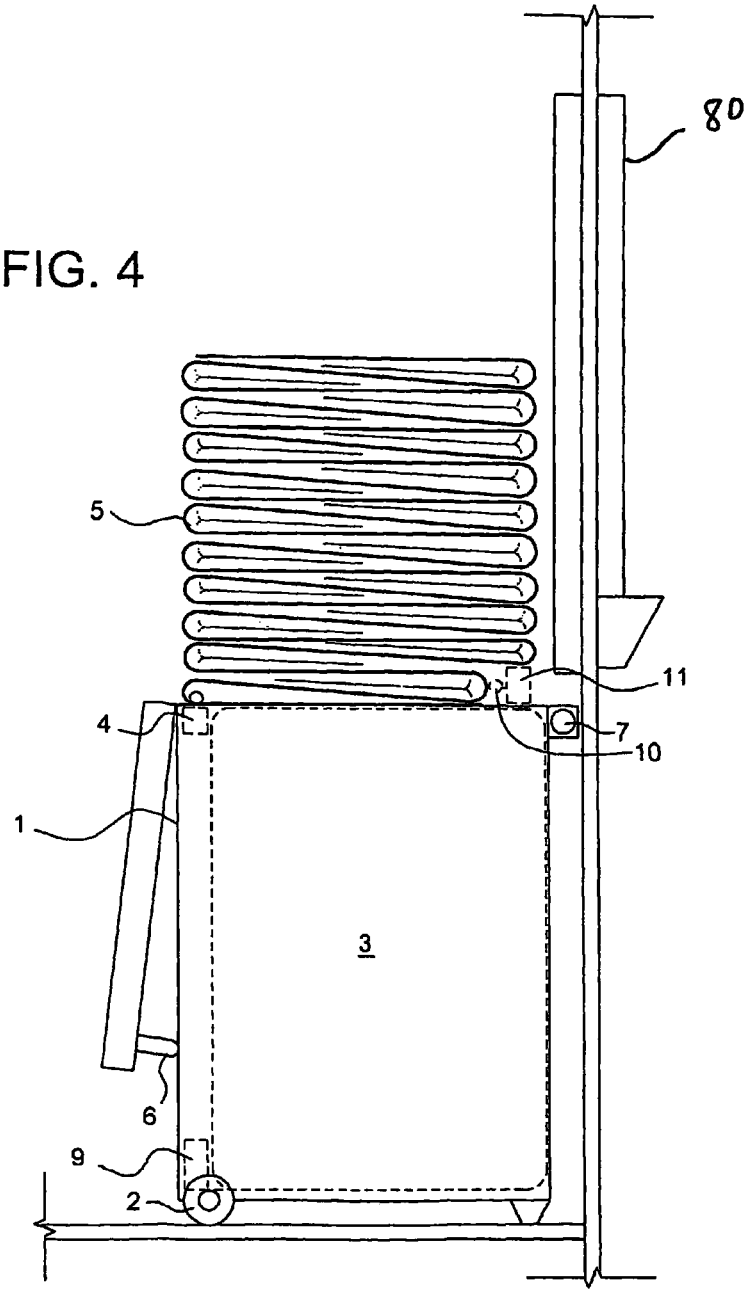
FIG. 4 is a representation of an embodiment of the present invention wherein the second canister has been activated, and the slide is beginning to inflate.

Referring to FIG. 4, a schematic diagram of the Life Saving Device for the Home is presented in which the slide 5 is sitting on top of the fully inflated pillow 3. The life saving device is positioned underneath an opened window 80. The container 1 holding the inflatable slide has two wheels 2 near the bottom of the container 1. At the top of the container 1 is a handle 6, which is used to transport the container 1. At the bottom of the inside of the container 1 is the inflated pillow 3. On top of the pillow 3 is the inflatable slide 5, wherein the inflatable slide 5 is in a tightly folded position. It is 24 feet long and 36 inches wide with 6 inch high sides when fully inflated.

Fitted to the back side and near the top of the container 1 is a metal bar 7, wherein the metal bar 7 is built into the container 1 to be positioned along the wall and window frame base. In an embodiment, the length of the metal bar is about 40 inches to about 50 inches. Preferably, the metal bar has a length of about 42 inches. The latches 7 and the metal bar 7 are pulled up parallel with the window ledge. In an embodiment, the latches 7 and metal bar 7 are pulled up snugly under the bottom window ledge (window sill) of the opened window 80. The latches 7 and metal bar 7 prevent the container 1 from being pulled out the window when the life saving device is activated. There are two activators which are pulled in order for the pillow and slide to inflate. The first activator 4 is located at the top side and within the container 1. The first activator 4 is operably connected to the first canister 9 which contains a compressed gas. In the event of emergency, the operator opens the top in a direction away from the opened window. The operator then pulls the first activator 4, wherein compressed gas from the first canister 9 inflates the pillow 3. The pillow 3 pushes the slide 5 up and out of the container 1. The operator must then push the inflatable slide 5 out of the open window 80 to expose the previously hidden second activator 10, wherein the second activator 10 is operably connected to the second canister 11. The second canister 11 contains an amount of compressed gas. The operator can then pull the second activator 10 to inflate the slide 5.

Figure 5:
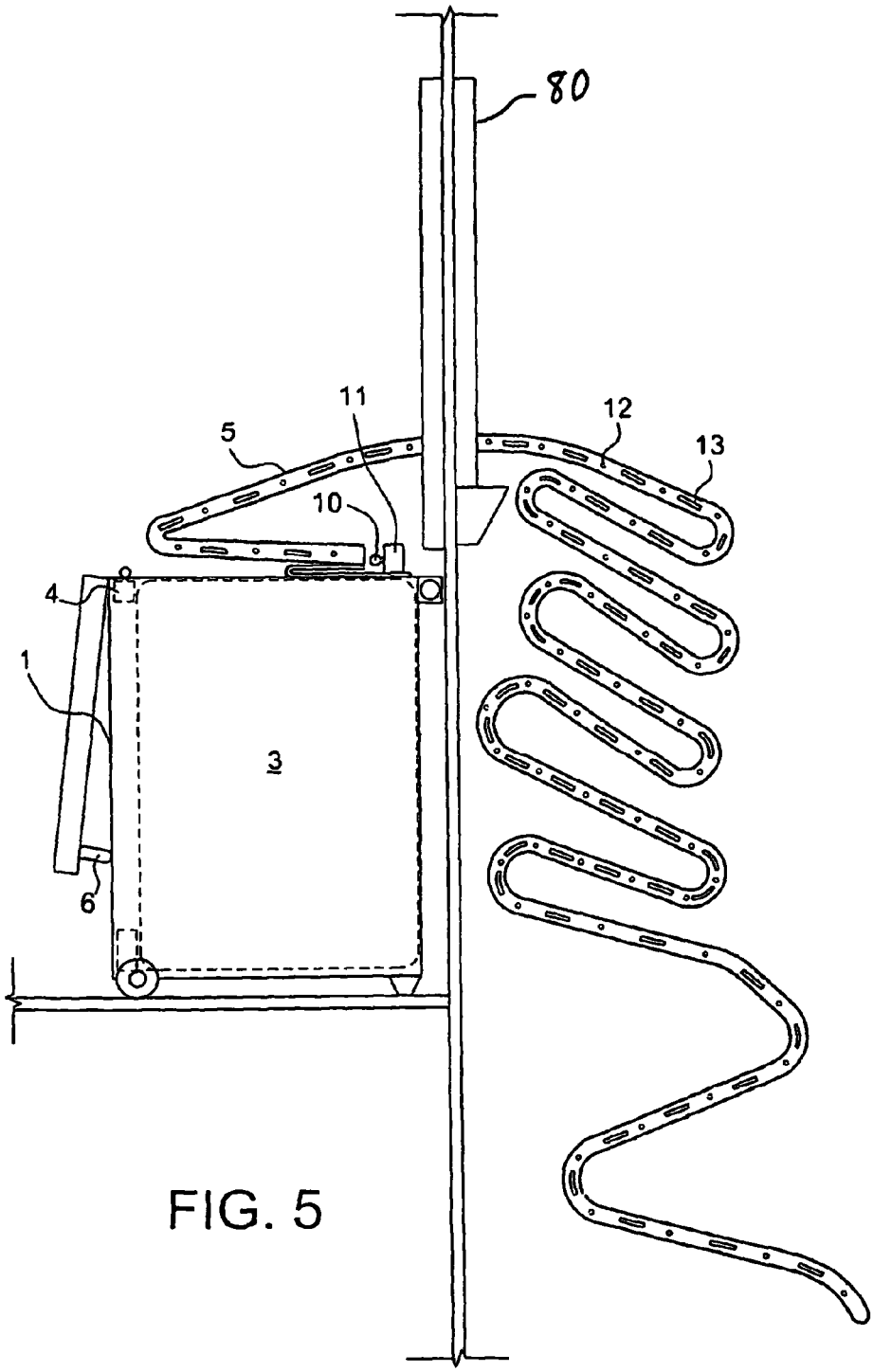
FIG. 5 is a representation of an embodiment of the present invention wherein the slide is inflating outside the window within 8-10 seconds.

Referring to FIG. 5, a schematic diagram of the Life Saving Device for the Home is presented wherein the slide 5 has been placed outside the opened window 80 and is inflating. Within 6-8 seconds the slide 5 is solid, firm, and ready for immediate use. The slide 5 is equipped with fluorescent stripes 13 on both the front and back and on the 6 inch sides. The fluorescent stripes 13 make the slide visible at night. Aspirators or funnels 13 on the sides of the slide 5 pull ambient air into the slide to assist in full inflation of the slide. Aspirators or funnels 13 close in an automatic fashion when the slide 5 is fully inflated. Second activator 10 has been pulled by the operator, and compressed gas from second canister 11 is filling the slide 5. Container 1 includes the fully inflated inner pillow 3, the first canister 4, and the handle 6.

Figure 6:
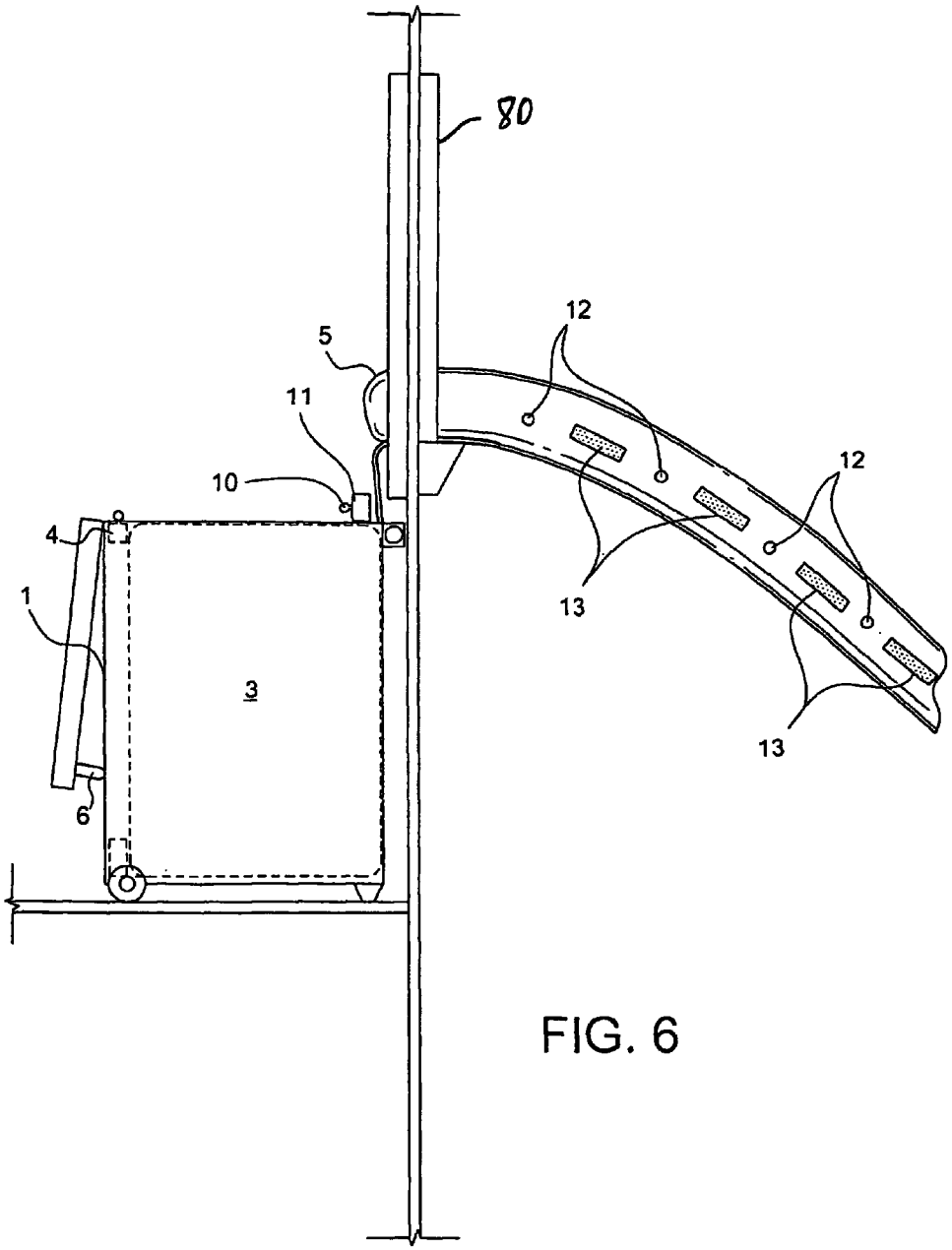
FIG. 6 is a representation of an embodiment of the present invention wherein the slide is fully inflated outside the open window, wherein the fluorescent stripes on the sides of the slide are visible.

Referring to FIG. 6, a schematic diagram of the Life Saving Device for the Home is presented wherein the slide 5 is fully inflated outside the open window 80. Also depicted in the diagram are the container 1, container handle 6, the first canister 4, the fully inflated pillow 3, the second activator 10, the second canister 11, the aspirators 12, and the fluorescent stripes 13.

Figure 7:
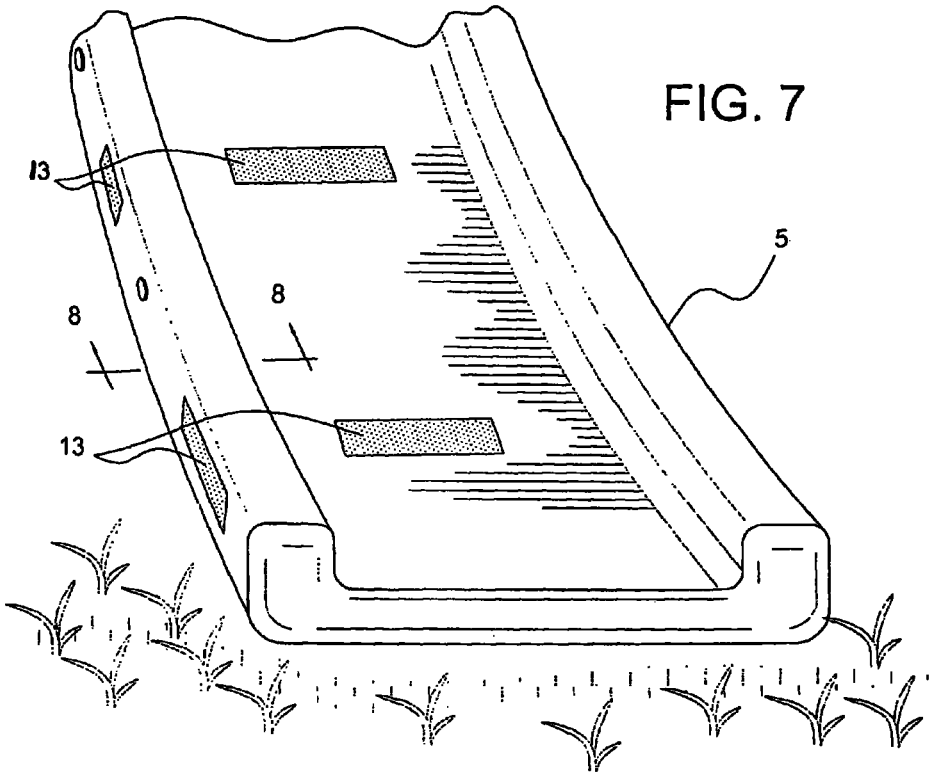
FIG. 7 is a representation of an embodiment of the present invention wherein the distal end of the slide is positioned on the ground.

Referring to FIG. 7, a schematic diagram of the Life Saving Device for the Home is presented wherein the distal end of the slide 5 is positioned on the ground. Also depicted in the diagram are fluorescent stripes 13 and inflated sides 8.

Figure 8:
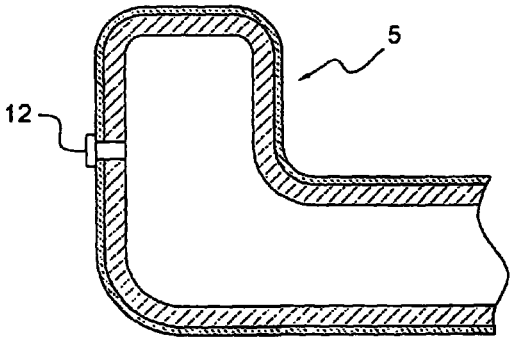
FIG. 8 is a representation of an embodiment of the present invention wherein a cutaway view of the slide reveals the interior and an intake valve (aspirator).

Referring to FIG. 8, a schematic diagram of the Life Saving Device for the Home is presented, in which a cut-away view of the fully inflated slide 5 is depicted, including an aspirator or funnel 12.

While the invention has been described by specific embodiments, there is no intent to limit the inventive concept except as set forth in the following claims.

We claim:

1. A method for escaping a burning building from an upper floor of the burning building, the method comprising: moving a life-saving device to a position directly underneath a window, wherein the window is selected from the group consisting of a second floor window and a third floor window, wherein the life-saving device comprises a container having a volume, wherein the container comprises a bottom, four sides, a top and a top cover; wherein the top cover is operatively connected to a side of the container by at least one hinge; an inflatable pillow wherein the inflatable pillow is positioned at the bottom of and within the container, and wherein the pillow, when fully inflated, fills substantially the entire volume of the container; a first canister including a compressed gas, wherein the first canister is operatively connected to the container, and wherein the first canister is operatively connected to the pillow; a visible first activator wherein the first activator is operatively connected to the first canister, wherein the first activator is positioned at the top of the container, and wherein the first activator is visible once the top cover of the container is opened; a folded inflatable slide having a proximal and distal end, wherein the slide is operatively connected to the inflatable pillow at its proximal end and, positioned on top of the inflatable pillow and within the container; a second canister including a compressed gas, wherein the second canister is operatively connected to the container, and wherein the second canister is operatively connected to the inflatable slide at its proximal end; and a hidden second activator wherein the second activator is operatively connected to the second canister; wherein the second activator is operatively connected to and adjacent to the proximal end of the inflatable slide; and wherein both the second activator and the second canister are located on top of the inflatable pillow and beneath the folded inflatable slide within the container; opening the window, wherein the window is opened to a position wide enough to allow a person egress from the window; securing the life-saving device underneath the opened window; opening the top of the container in a direction away from the opened window; pulling the first activator to inflate the inflatable pillow; pushing the inflatable slide outside the opened window, wherein the second activator and the second canister are located outside of the container and in view and made visible when the inflatable pillow is fully inflated; pulling the second activator to obtain an inflated slide; and sliding down the inflated slide.

2. The method according to claim 1 wherein the securing step compromises pulling Two metal sections at the ends of a metal bar upwardly and outwardly, wherin the metal bar is operably connected to the container; wherein the container is secured in position such that the container is not pulled out of the opened window upon inflation of the slide.

* * * * *